US010039993B2

(12) United States Patent
Antolin et al.

(10) Patent No.: US 10,039,993 B2
(45) Date of Patent: Aug. 7, 2018

(54) ROLLING MAGNETIC TOY

(71) Applicants: J. Vincente G. Antolin, Bloomingdale, IL (US); Robert Annis, Park Ridge, IL (US)

(72) Inventors: J. Vincente G. Antolin, Bloomingdale, IL (US); Robert Annis, Park Ridge, IL (US)

(73) Assignee: Big Monster Toys, LLC, Chicago, IL (US)

( * ) Notice: Subject to any disclaimer, the term of this patent is extended or adjusted under 35 U.S.C. 154(b) by 105 days.

(21) Appl. No.: 14/879,414

(22) Filed: Oct. 9, 2015

(65) Prior Publication Data

US 2016/0101372 A1 Apr. 14, 2016

Related U.S. Application Data

(60) Provisional application No. 62/062,527, filed on Oct. 10, 2014.

(51) Int. Cl.
*A63H 33/26* (2006.01)

(52) U.S. Cl.
CPC ..... *A63H 33/26* (2013.01)

(58) Field of Classification Search
CPC ..... A63H 33/26
USPC ..... 446/132
See application file for complete search history.

(56) References Cited

U.S. PATENT DOCUMENTS 1,462,028 A * 7/1923 Lo Cascio ..... A63F 5/04 273/141 R
2,818,680 A * 1/1958 Borsos ..... A63H 33/26 446/135
2,838,009 A * 6/1958 Bonanno ..... A63H 19/00 105/1.5
3,074,206 A * 1/1963 Fischl-Bernfi ..... A63H 1/30 273/109
3,690,393 A * 9/1972 Guy ..... A63H 18/10 105/77
3,805,443 A 4/1974 Duncan, Jr.
4,531,923 A * 7/1985 Lohr ..... A63H 33/26 273/109
4,723,588 A * 2/1988 Ruppel ..... E06B 9/165 160/235
4,871,340 A * 10/1989 Ross ..... A63H 33/26 446/132
4,917,644 A * 4/1990 Sunshine ..... A63F 9/34 273/456
5,155,400 A * 10/1992 Ming-Ji ..... F16H 35/00 310/68 E (Continued)

*Primary Examiner* — John E Simms, Jr.
*Assistant Examiner* — Dolores Collins
(74) *Attorney, Agent, or Firm* — Clifford H. Kraft

(57) ABSTRACT

A toy that has a pair of wheel-like members mounted on a central axle. The central axle is a ferrous metal rod with a pair of small permanent or other magnets attached to each end of the rod. The two magnets are positioned so that like poles face each other in opposition and face the center of the rod. A non-ferrous support plate such as a flat piece of wood with a metal strip on its edges forms a track. The magnets associated with the axle causes the toy to achieve the effect of clinging to the metal strip portions of the track. When the device is placed on the track, it will roll along the track under the force of gravity while magnetically clinging to the track in any horizontal or vertical position of the track.

15 Claims, 7 Drawing Sheets

(56) References Cited

U.S. PATENT DOCUMENTS

| | | | | |
|---|---|---|---|---|
| 7,275,974 | B2 * | 10/2007 | Perry | A63H 33/26 273/109 |
| 7,575,498 | B2 * | 8/2009 | Perry | A63H 33/26 273/109 |
| 8,604,900 | B2 * | 12/2013 | Kocijan | B60L 13/04 336/110 |
| 2014/0154945 | A1 | 6/2014 | Labarbara et al. | |

* cited by examiner

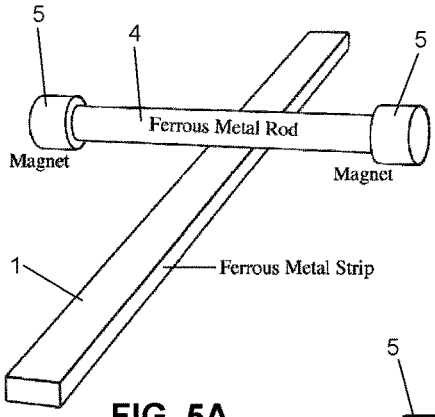
FIG. 5A
FIG. 5B
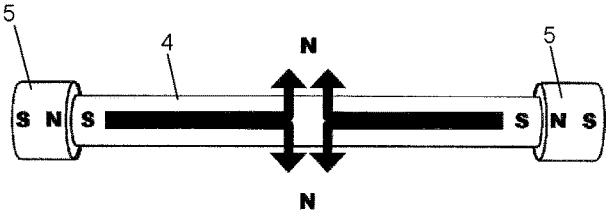

ROLLING MAGNETIC TOY

This application is related to, and claims priority from, U.S. Provisional Patent application No. 62/062,527 filed Oct. 10, 2014. Application 62/062,527 is hereby incorporated by reference in its entirety.

BACKGROUND

Field of the Invention

The present invention relates generally to toys that roll and more particularly to a toy that rolls on a metal track by clinging to it magnetically.

Description of the Prior Art

Toys that contain magnets are known in the art as well as toys that roll on tracks. None of these prior art toys feature a dual wheel structure with a central axle that magnetically clings to a track regardless of the vertical or horizontal position of the toy. Prior art track devices typically have two tracks and simply roll, but do not cling.

Yo-Yos are also known in the art. For example, Duncan, in U.S. Pat. No. 3,805,443 discloses a basic yo-yo. Numerous variations exist on the basic yo-yo such as those disclosed by Labarbara in U.S. Publication No. 2014/0154945. However, yo-yos are used with string, made of wood or plastic and do not generally run on tracks. What is needed is a toy with magnetic properties featuring a modified yo-yo-like structure that can follow a narrow track at a relatively constant speed in any vertical or horizontal position, and also be released from the track to perform tricks or to connect the rolling toy to other component track pieces and remain in continuous motion throughout the track structure circuit.

SUMMARY OF THE INVENTION

The present invention relates to a toy that has a dual wheel, yo-yo-like structure that resembles a pair of discs, door knobs or wheel-like members mounted on a central axle. The central axle is a ferrous metal rod with a pair of small permanent or other magnets attached to each end of the rod. The two magnets are positioned so that like poles face each other in opposition and face the center of the rod. The magnets are affixed to the wheels within the interior of the wheel structure and attached to the ends of the shaft of the axle. This causes the toy to achieve the effect of clinging to the metal strip portions of the track. Two possible configurations for the magnets to be attached to the axle are possible: S-N - - - N-S or N-S - - - S-N. Other configurations, for example N-S - - - N-S, fail to create a desired magnetic force perpendicular to the cylindrical surface at the center of the axle. A small portion of the axle is exposed at the center between the wheel members to allow contact with a ferrous metal flat strip or rod affixed to the track. The exposed section of the axle is slightly wider than the track. When the device is placed on the track, which is preferably a thin strip or rod, it will roll along the track under the force of gravity while magnetically clinging to the track in any horizontal or vertical position of the track. The device rolls at almost constant speeds determined by the diameter of the axle, the direction of gravity with respect to the orientation of the track, the strength of the magnets, and the acquired momentum. For example, the toy can be made to slowly accelerate downhill building up momentum (or equivalently kinetic energy) but at almost constant speed, and then following the track, to roll back uphill until this momentum (or energy) is dissipated, again, at almost constant speed. The track can follow any path, and can be configured into any combination of shapes. The toy rolls slowly along the track even at steep angles because of the clinging effect caused by the magnet interacting with the track. The outsides of the wheel members can be covered and decorated in any manner.

The device can be released from the magnetic track and allowed to roll free of the metal track or rail in order to speed up, or to change direction, jump, or be launched into other track structures which catch the wheel (at the axle) with another metal strip and allow it to continue on its journey through various track configurations. When the rotating wheel disengages from the single ferrous track onto a wider track section the wheels roll on the outer edges of the discs or the surface of the wheel members rather than the axle using no magnetic attraction. Due to the far larger circumference of the side wheels as compared to the circumference of the axle, the toy rapidly accelerates when released. This is because a point on the outside edge of a rotating disk travels a greater distance in one complete rotation than a point nearer the center.

The magnetic clinging effect, along with centrifugal force and momentum generated by the rotation, when combined with sections of both ferrous and non-ferrous track, allows the device to move in ways defying what would be assumed as the norm. Some examples of these are: rolling directly downward on a vertical rail at a very slow pace without falling off, rolling vertically uphill, clinging while rolling under a horizontal support, jumping gaps in the track and then reattaching to another track or device and suddenly slowing down or suddenly speeding up.

An important feature of the present invention is the use of a single track or rail having a flat ferrous metal strip or rod attached or imbedded in a support. A single track has numerous benefits including being easier to use, less expensive to manufacture, easier to locate, allow for engagement or disengagement from the track, have a smaller footprint, and provide the ability to control the speed, motion and direction of the rolling device.

DESCRIPTION OF THE FIGURES

Attention is now directed at several figures that illustrate features of the present invention:

FIG. 5A illustrates the magnetic components of the present invention.

FIG. 5B shows the magnet orientations and magnetic field relationships from the magnetic components of FIG. 5A.

Several drawings and illustrations have been presented to aid in understanding the present invention. The scope of the present invention is not limited to what is shown in the figures.

DESCRIPTION OF THE PREFERRED EMBODIMENTS

The present invention relates to a rolling magnetic toy that clings to a ferrous metal track as it rolls. The toy includes two wheel members or side disks spaced apart and mounted on the ends of a ferrous metal shaft or axle. A small section of the metal axle is exposed in the center of the arrangement to allow the magnetized portion of the axle to contact a metal track or rail. A pair of small magnets are attached to the metal axle, one on each end. The magnetic poles are placed in opposition such that either the two N poles of the magnets face toward the center of the axle, or the two S poles face the center of the axle. Other pole configurations will not produce a desired magnetic force perpendicular to the cylindrical surface of the axle.

When the toy is placed such that the exposed part of the central axle contacts a ferrous metal track, the toy clings to the track, and yet will roll slowly along the track under the influence of gravity. The toy can operate in any vertical or horizontal position including totally upside down. The toy rolls slowly even when the track is vertical because of the magnetic clinging effect.

Figure 1:
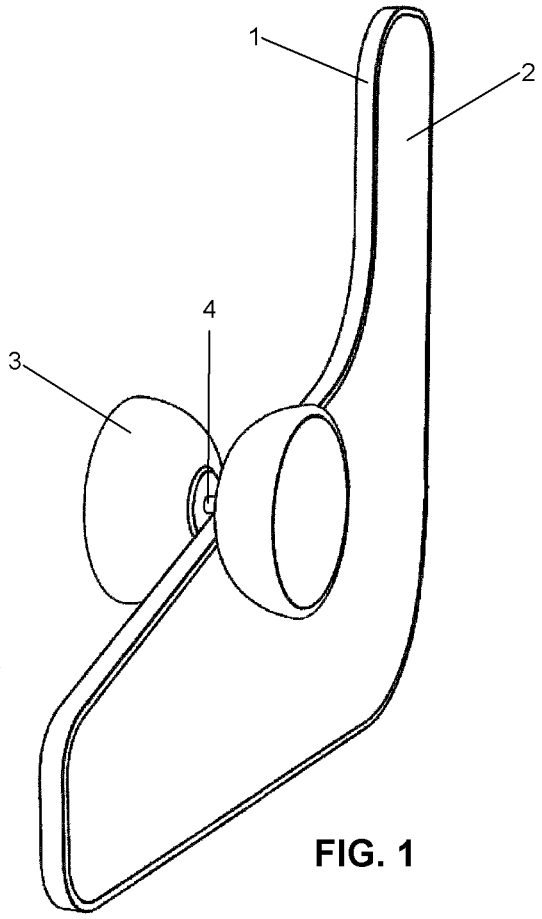
FIG. 1 shows an embodiment of the present invention on a continuous track.

Turning to FIG. 1, a preferred embodiment of the present invention can be seen placed on a continuous ferrous metal track 1. The track 1 is attached to the edge of a planar support member 2 that can be wood, plastic or any other non-ferrous material. Two side disk members or wheel members 3 form the body of the device with a part of the central ferrous metal axle 4 exposed and in contact with the track 1.

The track 1 in FIG. 1 is shown as being continuous; however, this is not required. In many embodiments and variations of the present invention, the track is not continuous. In fact, there can be regions where the metal track 1 ends and the wheel members 3 encounter a separate non-metal track where they simply roll as normal wheels, typically much faster than when the toy is on the metal track. The larger circumference of the wheel in proportion to the smaller shaft/axle allows the wheel to accelerate when released from the metallic portion of the track. The toy can roll quite rapidly in these regions depending on the slope because it only experiences normal rolling friction and no magnetic force. The metal track 1 may then optionally pick up again, and the toy will slow to its much slower clinging pace.

The embodiment of FIG. 1 can be held in a person's hand and rotated about the planer axis. The toy clings to the track 1 and progresses around the entire perimeter of the device, not falling off when it is on the bottom surface. Since the device clings to the track 1, it can descend and ascend nearly vertical slopes. When the device begins to roll down an incline of any steepness including vertical, it rolls at an approximately constant speed of about one inch per second (which can be changed by adjusting parameters) due to a pseudo-frictional effect caused by the magnetic clinging. There is some acceleration downhill and deceleration uphill; however, the overall effect is a small variation in an almost constant rolling speed. Even the fastest rolling speeds (say down a completely vertical slope) are much slower than that of a free-rolling or falling wheel. This is evident in configurations where the metal track 1 ends, and the side members 3 are allowed to act as normal wheels on a separate non-metal track. The toy is rolling at about one inch per second when it leaves the metal track 1. It immediately accelerates even under a mild slope to a considerably faster rolling speed, since now there is only normal wheel rolling friction to oppose the gravitational force.

The value of the approximately constant rolling speed is determined by the diameter of the metal axle, the strength of the magnets, the width of the track, and to a small extent, the direction of gravitational force. A larger diameter axle results in faster rolling. In fact, an optional collar can be placed around the axle if a rolling speed-up is desired in some embodiments. When the device rolls downhill, it accelerates very gradually since the forward gravitational force component is only slightly greater than the magnetic clinging force component acting backwards. This causes the device to slowly pick up kinetic energy (which depends on its overall mass). When the device is then caused to roll uphill, it decelerates gradually since the gravitational force component and the clinging force component are now both backwards. If it expends all its kinetic energy, it stops and can even reverse direction.

Figure 2:
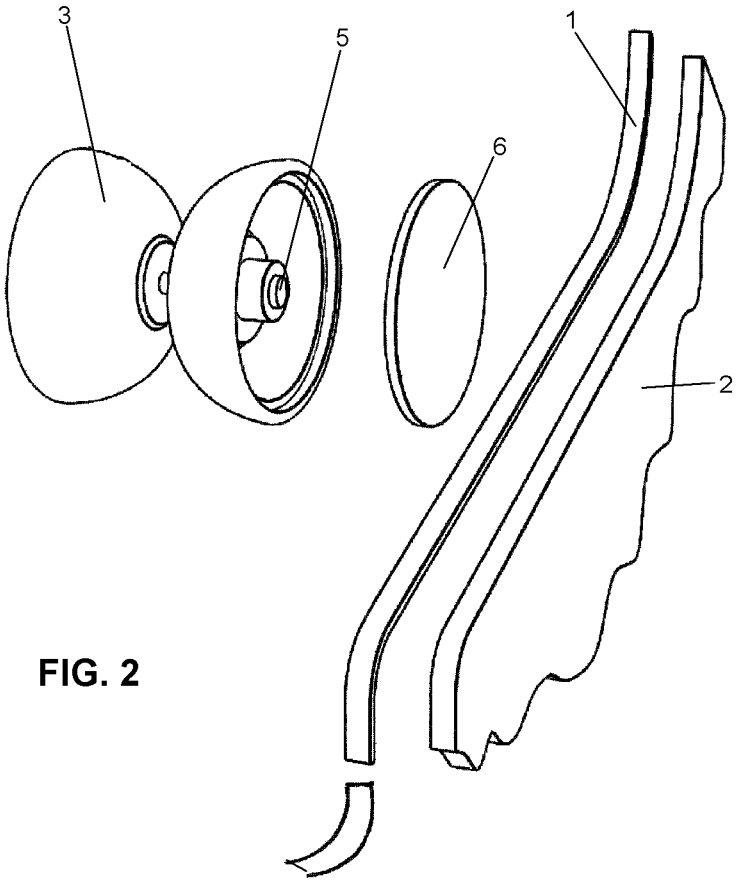
FIG. 2 shows details of the embodiment of FIG. 1.

FIG. 2 shows the embodiment of FIG. 1 with the cover 6 removed from one of the side disks 3, and the track 1 removed from the support 2. The location of one of the magnets 5 on the end of the axle can be seen.

Figure 3:
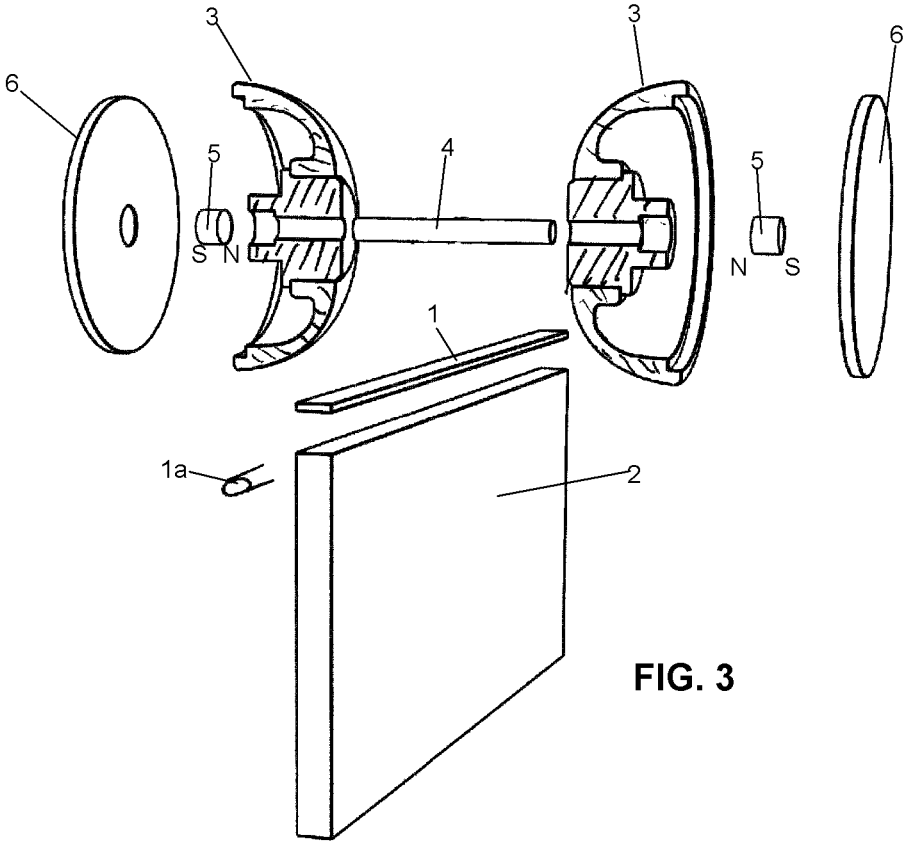
FIG. 3 shows a cross-section of a particular embodiment.

FIG. 3 shows a cross section of the side disks 3. The locations and orientations of the permanent magnets 5 can be seen. The magnets can be small cylindrical magnets or any other type or shape of magnet. For child safety, the magnets 5 should be permanently affixed to the end of the axle 4 or two the side members 3. They can optionally be glued or otherwise held in cavities in the side members 3. The magnets 5 should be in very close proximity to the ends of the axle 4 and preferably should make actual contact with it.

The track 1 is preferably a ferrous metal strip approximately 10-40 thousands of an inch thick and from ⅛ to ½ inch wide with a preferred width of approximately ¼ inch. Alternatively, the track 1*a* may be a rod instead of a strip. The track 1 can be mounted on the edge of a support 2 made of non-ferrous material such as plastic or wood. The support 2 can be cut in any shape or arbitrary design jigsaw puzzle piece-like, and the track 1 may be continuous or discontinuous along the edge. The track 1 can be glued to the support 2 or attached by any other method or means. In some embodiments, there may be no support. The axle or central shaft 4 of the toy is ferrous metal and with a preferred range of diameters from ⅛ inch to ½ inch in diameter with a preferred diameter of approximately 3⁄16 inch. Smaller than around 1⁄16 inch, the axle will not be strong enough, and there will not be enough magnetic force. Larger than around ½ inch causes the toy to roll too fast.

The side disk members or wheels 3 must be spaced far enough apart to allow a wide enough exposed part of the axle 4 that is slightly wider than the width of the track 1. The separations of the disk members 3 should not be so great that the device wobbles on the track or so tight that additional pinch or friction is introduced. The separation should be so that the device loosely fits on the track 1. The side disk members 3 should have enough mass to give allow the device to acquire a reasonable amount of momentum on downward trips; however, they should not be so massive that they fail to start to turn or climb.

While FIGS. 1-3 show the side disk members 3 as being round, this is not necessary unless the configuration is such that during part of a run, they will act as independent wheels (where the metal track 1 ends, and wheel tracks continue). In fact, the side members or wheel members 3 can be any shape including squares, stars, ellipses, triangles or any other shape. This is because the side members do not normally touch the support or anything else except the central axle 4 The central axle 4 should pass through their centers of gravity for optimum performance. In addition, the exterior covers 6 on the side members 3 can be decorated, painted, lighted or have any other manner of display. The covers 6 are optional.

Figure 4:
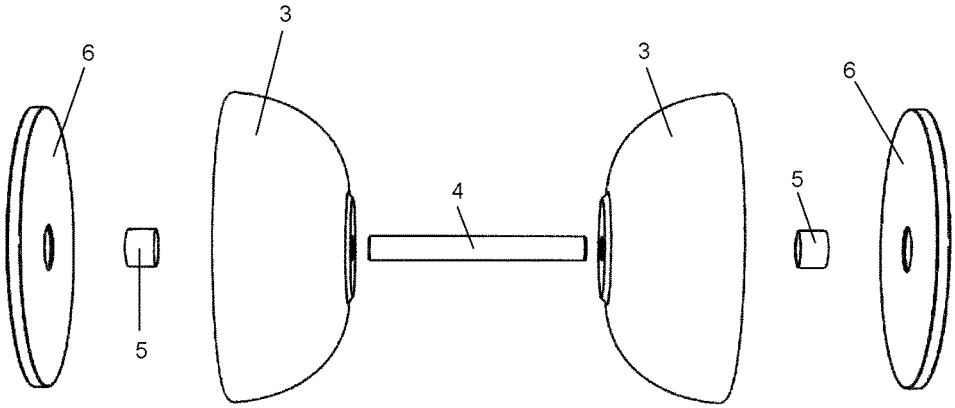
FIG. 4 shows an exploded view of a particular embodiment.

FIG. 4 shows an exploded view of an embodiment of the invention. Again, the relationship between the side members 3, the central axle 4, the magnets 5 and the covers 6 can be seen. FIG. 4 shows the covers 6 with holes; however, this is not necessary. The covers 6 can be any non-ferrous material and can have any surface or decorations.

FIG. 5A shows the relationship between the magnetic components of the present invention. A ferrous metal rod or axle 4 is capped with a pair of small permanent magnets 5 positioned on the axle 4 with like poles facing each other. The axle 4 rolls on a ferrous metal track 1. FIG. 5B shows the relationships between the magnetic forces in the axle 4. The magnets 5 are placed so that either the two north poles face the center of the axle 4, or the two south poles face the center of the axle 4. The clinging force that is perpendicular to the cylindrical surface of the axle 4 will not exist otherwise. It can be seen in FIG. 5B that this arrangement leads to a magnetic force component perpendicular to the cylindrical surface of the axle. It is this component that causes the clinging effect.

In some embodiments of the present invention, two sections of track or rails can come into a junction from different angles and be slightly separated with a rollway for the side member wheels with a stop that forces one wheel to stop or slow, but allows the other to turn freely. This arrangement causes the toy to abruptly turn through just about any angle as it leaves one section of the metal track and enters the second section. Of course, the metal track itself can also meander or turn through different angles.

Figure 6:
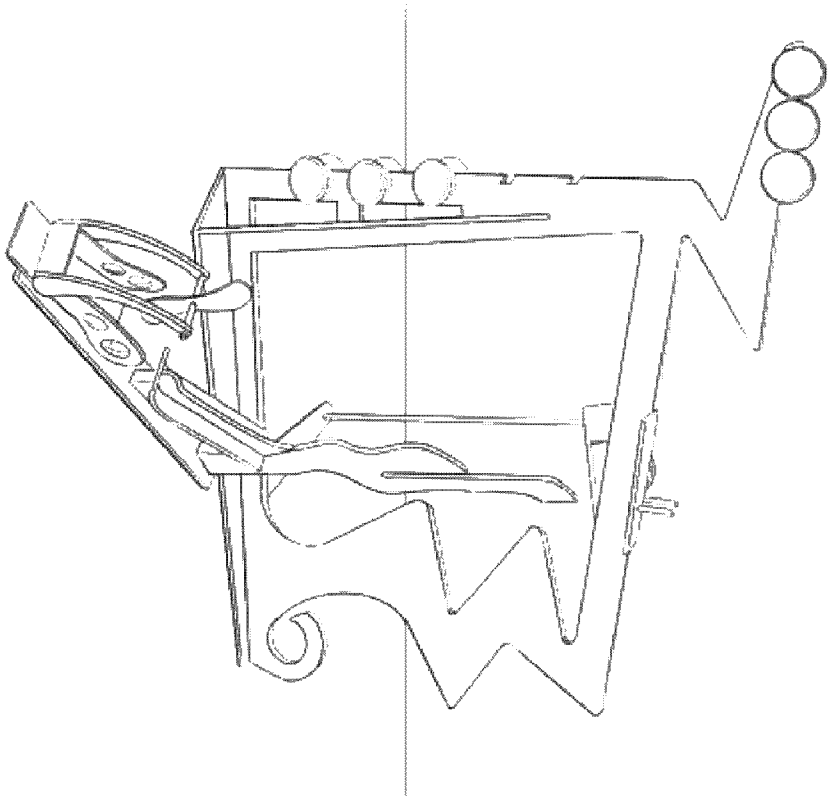
FIG. 6 shows a more complex track configuration.

FIG. 6 shows one of many possible configurations of tracks for the toy.

Figure 7:
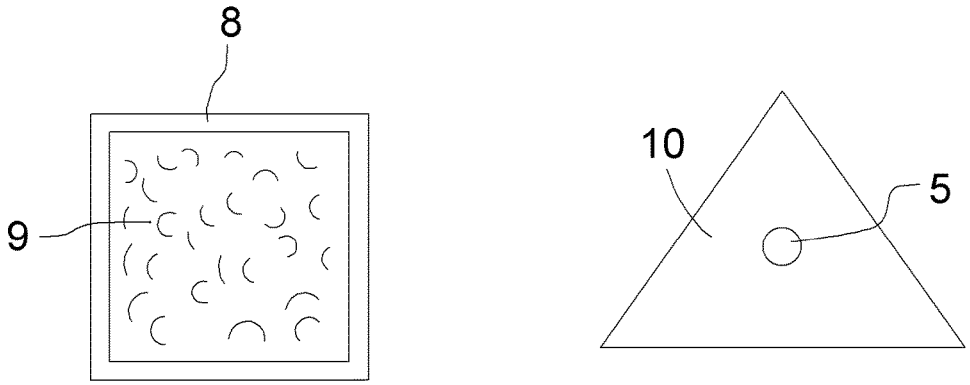
FIG. 7 shows square and triangular wheel members.

FIG. 7 shows square and triangular wheel configurations. The square wheel member 8 is equipped with a decorated cover 9. The triangular wheel member 10 shows the magnet 5 at its center.

While the figures and descriptions have called for permanent magnets, any type of magnet may be used as long as the poles are in opposition (like poles facing one-another). In particular, electromagnets could be used.

Several descriptions and illustrations have been presented to aid in understanding the present invention. One with skill in the art will realize that numerous changes and variations may be made without departing from the spirit of the invention. Each of these changes and variations is within the scope of the present invention.

We claim:

1. A magnetic roller toy device comprising:
   - a ferrous metal central axle passing through two side members centrally separated from each other to expose a portion of the axle;
   - a pair of permanent magnets, one attached to each end of the central axle, the permanent magnets positioned so that like poles of the permanent magnets face each other causing an opposing magnetic field in the axle;
   - a continuous flat ferrous metal strip connected end-to-end attached to an edge of a flat non-ferrous plate, the width of the metal strip being slightly narrower than the portion of the axle exposed;
   - the toy adapted to be placed on the metal strip in a manner where the exposed portion of the axle contacts one flat surface of the metal strip wherein the roller toy rolls with approximately constant speed along the strip with the support in any vertical or horizontal position under gravitational force and a clinging magnetic force existing between the axle and the track.

2. The magnetic roller toy device of claim 1 wherein the two side members are round wheel-like members.

3. The magnetic roller toy device of claim 1 wherein the axle has a diameter of approximately ⅛ inch.

4. The magnetic roller toy device of claim 1 wherein the flat strip has a width of approximately ¼ inch.

5. The magnetic roller toy device of claim 1 wherein a portion of the flat strip is not continuous, but contains a gap of non-ferrous material inserted between ends of the ferrous strip, wherein, the roller toy accelerates as it crosses the gap.

6. The magnetic roller toy device of claim 5 further comprising a wheel stop for one of the wheel members at said gap, wherein, the roller toy turns at an abrupt angle as it passes over the gap.

7. The magnetic roller toy device of claim 1 wherein the side members are square.

8. The magnetic roller toy device of claim 1 wherein the side members are triangles.

9. The magnetic roller toy device of claim 1 wherein the side members have decorated covers.

10. A magnetic roller toy comprising:
   - a ferrous metal axle passing through two non-ferrous wheels separated from each other to expose a central portion of the axle;
   - a pair of permanent magnets, one attached to each end of the axle, the permanent magnets positioned so that like permanent magnetic poles face each other;
   - a flat non-ferrous support plate having jigsaw puzzle-like curved edges cut to an arbitrary design;
   - a thin, flat ferrous metal strip connected end-to-end and attached to an edges of the flat non-ferrous support plate, the width of the ferrous metal strip being slightly narrower than the central exposed portion of the axle wherein a portion of the ferrous metal strip is not continuous, but contains a gap of non-ferrous material attached between ends of the ferrous metal strip;
   - the toy adapted to be placed on the ferrous metal track in a manner where the exposed central portion of the axle contacts the metal track, wherein the toy rolls along the strip at approximately constant speed with the track in any vertical or horizontal position under gravitational force and a clinging magnetic force existing between the axle and the track, except that when the toy crosses the gap of non-ferrous material, it accelerates.

11. The magnetic roller toy of claim 10 wherein the axle has a diameter of approximately ⅛ inch.

12. The magnetic roller toy of claim 10 wherein the strip is a thin metal strip with a width of approximately ¼ inch.

13. The magnetic roller toy device of claim 10 further comprising a wheel stop for one of the wheels at said gap, whereby the roller toy turns at an abrupt angle as it passes over the gap.

14. A roller toy that exhibits yo-yo motion as it rolls along a descending and ascending track comprising:
   - a non-ferrous support plate constructed to be used in a vertical configuration with at least part of an upper edge smoothly cut to a shape of a descending and ascending roller-coaster curve;
   - a thin un-permanently magnetized ferrous metal strip attached to the upper edge along the descending and ascending curve;
   - a roller device with a pair of wheels attached to a cylindrical un-permanently magnetized ferrous metal axle extending between the wheels with a portion of the axle exposed that is slightly wider than the ferrous metal strip;
   - a pair of permanent magnets, each having a permanent north and south pole, wherein one of the permanent magnets is attached to each end of the cylindrical metal axle with their permanent magnetic poles in opposition to each other so that if the north pole of one permanent magnet is attached to the axle at a first end, the north pole of the other permanent magnet is attached to the axle at a second end, or if the south pole of one permanent magnet is attached to the axle at the first end, the south pole of the other permanent magnet is attached to the axle at the second end;

wherein, when the roller device is placed with the exposed portion of the axle in contact with the metal strip, the roller device will descend and ascend the roller-coaster curve at approximately constant speed.

15. The roller toy of claim 14 wherein there is a gap of non-ferrous material for a predetermined distance in the ferrous metal strip in a region where the wheels also contact a flat surface, wherein the roller device accelerates as it passes over the gap.

* * * * *